US006079331A

United States Patent [19]

Koguchi et al.

[11] Patent Number: 6,079,331

[45] **Date of Patent: *Jun. 27, 2000**

[54] PLATE MAKING DEVICE AND PRINTER AND PRINTING SYSTEM USING THE PLATE MAKING DEVICE

[75] Inventors: Hideyuki Koguchi; Takao Nakayama; Koji Kamiyama, all of Kanagawa-ken, Japan

[73] Assignee: Fuji Photo Film Co., Ltd., Kanagawa-ken, Japan

[ * ] Notice: This patent is subject to a terminal disclaimer.

[21] Appl. No.: 09/178,640

[22] Filed: Oct. 26, 1998

[30] Foreign Application Priority Data

Oct. 24, 1997 [JP] Japan ..... 9-292616
Oct. 24, 1997 [JP] Japan ..... 9-292618

[51] Int. Cl.[7] ..... B41C 1/10

[52] U.S. Cl. ..... 101/467; 101/465; 101/466; 101/478

[58] Field of Search ..... 101/453–456, 101/463.1, 465–467, 478; 430/302

[56] References Cited

U.S. PATENT DOCUMENTS

| | | | |
|---|---|---|---|
| 3,506,779 | 4/1970 | Brown et al. | 358/297 |
| 3,549,733 | 12/1970 | Caddell | 101/401.1 |
| 3,574,657 | 4/1971 | Burnett | 101/467 |
| 3,739,033 | 6/1973 | Anello et al. | 568/677 |
| 3,832,948 | 9/1974 | Barker | 101/401.1 |
| 3,945,318 | 3/1976 | Landsman | 101/467 |
| 3,962,513 | 6/1976 | Eames | 428/323 |
| 3,964,389 | 6/1976 | Peterson | 101/467 |
| 4,034,183 | 7/1977 | Uhlig | 219/122 |
| 4,063,949 | 12/1977 | Uhlig et al. | 101/467 |
| 4,081,572 | 3/1978 | Pacansky | 427/53 |
| 4,693,958 | 9/1987 | Schwartz et al. | 430/302 |
| 4,718,340 | 1/1988 | Love, III | 101/467 |
| 4,731,317 | 3/1988 | Fromson et al. | 430/159 |
| 5,206,102 | 4/1993 | Tench | 101/467 |
| 5,238,778 | 8/1993 | Hirai et al. | 430/200 |
| 5,353,705 | 10/1994 | Lewis et al. | 101/453 |
| 5,385,092 | 1/1995 | Lewis et al. | 101/467 |
| 5,395,729 | 3/1995 | Reardon et al. | 430/200 |
| 5,713,287 | 2/1998 | Gelbart | 101/478 |
| 5,743,188 | 4/1998 | Ghosh et al. | 101/478 |
| 5,816,161 | 10/1998 | Nussel et al. | 101/478 |
| 5,836,249 | 11/1998 | Chatterjee et al. | 101/478 |

FOREIGN PATENT DOCUMENTS

| | | |
|---|---|---|
| 0 001 068 | 3/1979 | European Pat. Off. . |
| 0 242 863 | 10/1987 | European Pat. Off. . |
| 0 769 372 | 4/1997 | European Pat. Off. . |
| 196 12 927 | 11/1996 | Germany . |
| 54-63902 | 5/1979 | Japan . |
| 58-5796 | 2/1983 | Japan . |
| 7-56351 | 3/1995 | Japan . |
| 9-169098 | 6/1997 | Japan . |

OTHER PUBLICATIONS

Japanese Unexamined Patent Publication No. 9(1997)–131914—Abstract.

*Primary Examiner*—Stephen R. Funk
*Attorney, Agent, or Firm*—Sughrue, Mion, Zinn, Macpeak & Seas, PLLC

[57] ABSTRACT

A plate material the surface of which is formed of film including as its major component a material whose surface changes from a lipophilic state to a hydrophilic state by a photocatalytic reaction and returns to a lipophilic state when subsequently subjected to a heat treatment is used for making a printing plate. The plate material is exposed to active light over the substantially entire surface thereof with image-wise part kept unexposed. The part exposed to the active light becomes hydrophilic and repels ink while the part unexposed to the active light is kept lipophilic and receives ink. When the plate material is subsequently heated, the hydrophilic part is rendered lipophilic and the plate material can be reused.

15 Claims, 7 Drawing Sheets

PLATE MAKING DEVICE AND PRINTER AND PRINTING SYSTEM USING THE PLATE MAKING DEVICE

BACKGROUND OF THE INVENTION

1. Field of the Invention

This invention relates to a plate making device for a general light printer, particularly to an offset printer, which facilitates making a printing plate and makes it feasible to repeatedly recycle and reuse the printing plate. This invention further relates to a printer and a printing system using such a plate making device.

2. Description of the Related Art

Offset printing has been in wide use among others due to its simple plate making step. This printing method is based on immiscibility of oil and water, and oil material, i.e., ink, and fountain solution are selectively held in an imaged region and a non-imaged region, respectively. When a printing medium is brought into contact with the surface of the plate directly or by way of an intermediate member called a blanket, the ink on the imaged region is transferred to the printing medium, whereby printing is effected.

A prevailing method of the offset printing involves use of a PS plate which comprises an aluminum base plate and a diazo photosensitive layer formed on the base plate. In the PS plate, the surface of the aluminum base plate is subjected to sand dressing, anodizing and other steps in order to enhance ink receptivity of the imaged region and ink repellency of the non-imaged region, to increase durability against repeated printing and to increase fineness of the printing plate. An image to be printed is formed on the surface of the PS plate thus processed. Accordingly, the offset printing is excellent in durability against repeated printing and fineness in the printing plate as well as simplicity.

However as the printed matter spreads wider, there arises a demand for simpler offset printing and there have been proposed various simple printers.

The typical examples of such simple printers include printers in which a printing plate is made by use of a silver salt diffusion transfer method such as a "Copyrapid" offset printer available from "Agfa-Gevaer", a printer disclosed for instance in Japanese Unexamined Patent Publication No. 7(1995)-56351, and the like. In such printers, a transfer image can be formed in one step on a plate material and since the transfer image is lipophilic, the plate can be used as a printing plate as it is. However since even such printers require a diffusion transfer development step using an alkali developing solution, there is a demand for further simpler printer which requires no developing step by a developing solution.

Thus there have been made attempts to realize a simple printing plate which requires no developing step by an alkali developing solution. In the field of the simple printing plate, which is called a non-processed printing plate since it omits necessity of a developing step, there have been proposed various techniques primarily based on one of principles of (1) forming an image by recording an image on the surface of a plate material by image-wise exposure and thermally decomposing the exposed portion of the plate material, (2) forming an image by rendering lipophilic the exposed portion of the plate material in image-wise exposure by heat mode curing, (3) forming an image by rendering lipophilic the exposed portion of the plate material in image-wise exposure by light mode curing, (4) forming an image by modification of the surface of a plate material through decomposition by light, and (5) forming an image by heat mode melt transfer of an imaged portion.

The aforesaid simple offset printers are disclosed, for instance, in U.S. Pat. Nos. 3,506,779; 3,549,733; 3,574,657; 3,739,033; 3,832,948; 3,945,318; 3,962,513; 3,964,389; 4,034,183; 4,081,572; 4,693,958; 4,731,317; 5,238,778; 5,353,705; 5,385,092; and 5,395,729 and EP No. 1068.

Notwithstanding their advantage that they use no developing solution in making a printing plate, the aforesaid printers have one or more of the following drawbacks and are practically unsatisfactory. An unsatisfactory difference between the lipophilic region and the hydrophilic region, which results in poor quality of a printed image, poor resolution, which results in difficulty in obtaining a sharp printed image, an insufficient mechanical strength of the surface of a printed image to such an extent that the surface of the printed image is apt to be scratched, which requires provision of protective film or the like and deteriorates simplicity of the printer, and an insufficient durability against printing for a long time. Thus a strong demand for a printing plate which can be easily made and has various properties required in printing is not satisfied yet.

As a method of making a non-processed printing plate, there has been disclosed in Japanese Unexamined Patent Publication No. 9(1997)-169098 a method which utilizes a phenomenon that zirconia ceramic is rendered hydrophilic by exposure to light. However zirconia is insufficient in photosensitivity and cannot be sufficiently rendered hydrophilic from its hydrophobic (lipophilic) state. Accordingly the approach is disadvantageous in that the imaged region and the non-imaged region are not sufficiently distinguishable from each other.

Further it will be advantageous from the viewpoint of reduction in both cost and waste if a used printing plate can be easily recycled and reused. Simplicity of recycle operation is very important in recycle and reuse of printing plates, and it has been a very difficult problem to simplify the recycle operation. Accordingly there has been little disclosure on a method of overcoming this problem except Japanese Unexamined Patent Publication No. 9(1997)-169098 where the recycle operation is mentioned only on a zirconia ceramic plate material.

SUMMARY OF THE INVENTION

In view of the foregoing observations and description, the primary object of the present invention is to provide a plate making device which can make without use of alkali developing solution a printing plate which can provide a practically sufficient image quality and can be recycled for reuse. Specifically the present invention provides a plate making device which can make without use of alkali developing solution a printing plate which is excellent in resolution and high in distinguishability between the imaged region and the non-imaged region and accordingly can provide an image of high quality.

Another object of the present invention is to provide a printing system using the plate making device.

Still another object of the present invention is to provide a printer using the plate making device.

After various investigations, we have found existence of a material whose surface changes from a lipophilic state to a hydrophilic state upon exposure to light and returns to a lipophilic state when subsequently subjected to a heat treatment. This invention has been made on the basis of this discovery.

That is, in accordance with a first aspect of the present invention, there is provided a plate making device comprising a plate material which is removably provided and has a surface layer formed of film including as its major component a material whose surface changes from a lipophilic state to a hydrophilic state by a photocatalytic reaction and returns to a lipophilic state when subsequently subjected to a heat treatment, an exposure means which exposes the plate material to active light over the substantially entire surface thereof with image-wise part kept unexposed, and a heating means which heats the plate material.

The "material whose surface changes from a lipophilic state to a hydrophilic state by a photocatalytic reaction and returns to a lipophilic state when subsequently subjected to a heat treatment" will be referred to as "photo-thermal hydrophilicity convertible material", hereinbelow. The "active light" is light which stimulates the photo-thermal hydrophilicity convertible material to change its surface from a lipophilic state to a hydrophilic state.

In one preferred embodiment of the present invention, the plate material is in the form of a flat plate which is removably mounted on the surface of a drum and the exposure means and the heating means are disposed around the drum.

In another preferred embodiment of the present invention, the plate material is in the form of a plate cylinder and the exposure means and the heating means are disposed around the plate cylinder.

The exposure means may be, for instance, a means which holds, on the plate material, lith film bearing thereon an original image to be printed and exposes the plate material to active light through the lith film or a means which causes an active light beam, modulated on the basis of the original image to be printed, to scan the surface of the plate material.

Preferably the photo-thermal hydrophilicity convertible material is titanium oxide or zinc oxide.

Further it is preferred that the plate making device be provided with an ink removing means for removing ink remaining on the plate material, more strictly on the printing plate made of the plate material, after printing.

In accordance with a second aspect of the present invention, there is provided a printing system comprising a plate making device of the first aspect, at least one printer including a plate support means on which a printing plate removed from the plate making device is removably mounted and an ink supply means which supplies ink to the unexposed (imaged) region of the printing plate, and an ink removing means for removing ink remaining on the printing plate after printing.

The ink removing means may be provided either on the printer or the plate making device.

It is preferred that the printing system comprises at least four said printers.

In accordance with a third aspect of the present invention, there is provided an offset printer comprising a plate making section consisting of a plate material which has a surface layer formed of film including as its major component a material whose surface changes from a lipophilic state to a hydrophilic state by a photocatalytic reaction and returns to a lipophilic state when subsequently subjected to a heat treatment, an exposure means which exposes the plate material to active light over the substantially entire surface thereof with image-wise part kept unexposed, an ink supply means which supplies ink to the unexposed (imaged) region of the plate material, an ink removing means for removing ink remaining on the plate material after printing, and a heating means which heats the plate material, and a transfer section which transfers ink on the unexposed region of the plate material to a printing medium.

It is preferred that the plate material be in the form of a plate cylinder and the exposure means, the ink supply means, the removing means, and heating means be disposed around the plate cylinder.

Also in the offset printer, the exposure means may be, for instance, a means which holds on the plate material lith film bearing thereon an original image to be printed and exposes the plate material to active light through the lith film or a means which causes an active light beam, modulated on the basis of the original image to be printed, to scan the surface of the plate material.

It is preferred that the offset printer comprises at least four said print making sections.

Preferably the photo-thermal hydrophilicity convertible material is titanium oxide or zinc oxide.

In the plate making device, the printing system and the printer in accordance with the present invention, the part of the surface of the plate material exposed to the active light changes from a lipophilic state to a hydrophilic state. Accordingly by exposing the substantially entire surface of the plate material with image-wise part kept unexposed, the image-wise part unexposed to the active light is kept lipophilic and the exposed part is rendered hydrophilic, whereby a lipophilic imaged region and a hydrophilic non-imaged region are formed on the surface of the plate material. Thus a printing plate bearing thereon a lipophilic image is made. When the printing plate is set to a printer and ink is supplied on the printing plate, the ink is held only on the lipophilic imaged region and is not held on the hydrophilic non-imaged region, whereby an ink image is formed on the printing plate. The ink image is then transferred to a printing medium. When ink remaining on the printing plate is removed after printing and the printing plate is heated by the heating means, the non-imaged region, i.e., the region exposed to the active light returns to the lipophilic state and the printing plate is restored to the state before exposure thereof to the active light.

Accordingly in accordance with the present invention, a printing plate can be made only by reverse-image-wise exposure of a plate material to the active light without necessity of development. Further the printing plate thus made is high in distinguishability between the imaged region and the non-imaged region, which ensures high sharpness of the printed image. Further since the printing plate is restored to the original state where it is lipophilic over the entire surface by heating the printing plate, the plate material can be repeatedly used, whereby printed matter can be provided at low cost.

When the plate material is in the form of a flat plate which is removably mounted on the surface of a drum or in the form of a plate cylinder and the exposure means and the heating means are disposed around the drum or the plate cylinder, the reverse-image-wise exposure and the heating can be effected only by rotating the drum or the plate cylinder, the plate making device can be compact in size and space can be saved.

Further by holding on the plate material lith film bearing thereon an original image to be printed and exposing the plate material to active light through the lith film, necessity of making a printing plate outside the system as in the case of a PS plate is eliminated and the printing step is simplified.

Further by scanning the surface of the plate material by an active light beam modulated on the basis of the original image to be printed, necessity of making lith film bearing thereon an original image to be printed as in the case of PS plate is eliminated, whereby the printing step is simplified and consumption of materials such as lith film can be reduced.

When the ink removing means is provided on the plate making device, the printing system using the plate making device can be simple in structure since the ink removing step is carried out in the plate making device.

When the printing system of the present invention is provided with at least four printers, color printing can be carried out by supplying ink of different colors at the respective printers.

Further, in the offset printer of the present invention, the printing plate need not be removed from the printer, and accordingly there is no fear that foreign material such as dust adheres to the printing plate when incorporating the printing plate in the printer as in the case of a conventional PS plate.

Further, in the offset printer of the present invention, when the plate material is in the form of a plate cylinder itself and the exposure means, the ink supply means, the ink removing means and the heating means are disposed around the drum or the plate cylinder, the reverse-image-wise exposure, supply of ink, removal of ink and the heating can be effected only by rotating the plate cylinder, the offset printer can be compact in size and space can be saved.

Further when the offset printer of the present invention is provided with at least four plate making sections, color printing can be carried out by supplying ink of different colors at the respective plate making sections.

DESCRIPTION OF THE PREFERRED EMBODIMENTS

This invention is based on the discovery of existence of a material such as titanium oxide or zinc oxide whose surface changes from a lipophilic state to a hydrophilic state upon exposure to light and returns to a lipophilic state when subsequently subjected to a heat treatment, and is characterized in that such nature of the photo-thermal hydrophilicity convertible material is utilized in making a printing plate and recycling the same.

Figure 1:
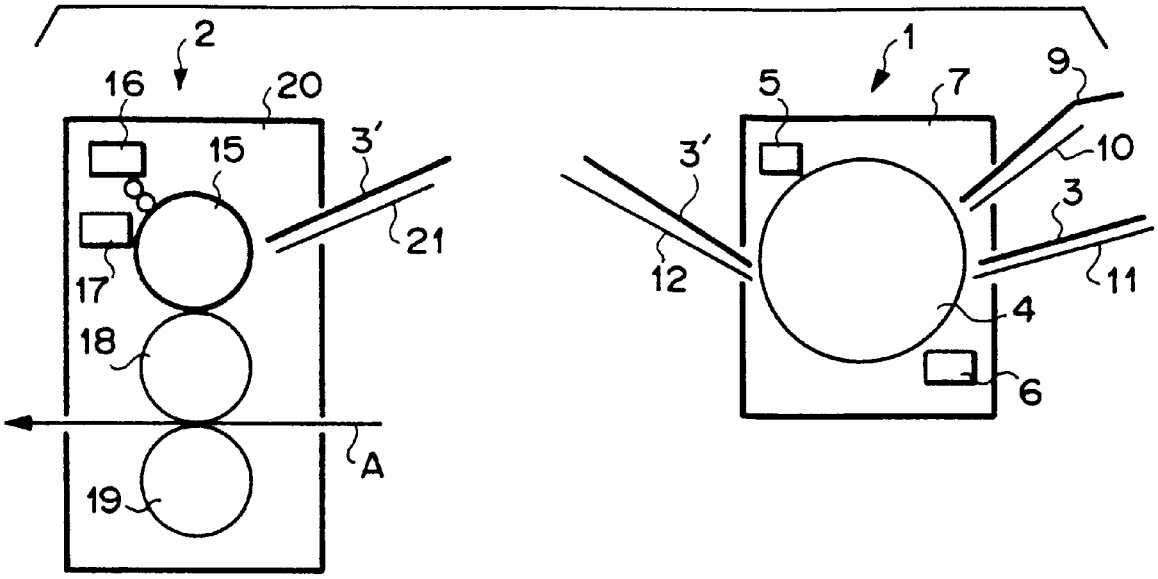
FIG. 1 is a schematic view for illustrating a printing system in accordance with a first embodiment of the present invention.

FIG. 1 shows a printing system in accordance with a first embodiment of the present invention. As shown in FIG. 1, the printing system of this embodiment comprises a plate making device 1 and a printer 2.

The plate making device 1 comprises an exposure drum 4 around which a plate material 3 in the form of a flat plate having a surface layer containing a photo-thermal hydrophilicity convertible material such as titanium oxide or zinc oxide as a major component is wrapped, an active light exposure section 5 which exposes the plate material 3 to active light over the substantially entire surface thereof with image-wise part kept unexposed, and a heating section 6 which heats the plate material 3. These elements are disposed inside a housing body 7. The housing body 7 is further provided with a film supply section 10 for supplying lith film 9, a plate material supply section 11 for supplying a plate material 3 to the housing body 7 and a plate discharge section 12 for discharging a printing plate 3' made by the plate making device 1 as will be described later.

The printer 2 comprises a plate cylinder 15 around which the printing plate 3' is wrapped, an ink/water supply section 16 which supplies ink and fountain solution on the surface of the printing plate 3', an ink washing section 17 which removes ink on the printing plate 3' on the plate cylinder 15 after printing, a blanket 18 as an intermediate member for transferring ink on the printing plate 3' to a sheet of printing paper and an impression cylinder 19 which presses the sheet of printing paper against the blanket 18. These elements are disposed inside a printer housing 20. The printer housing 20 is further provided with a printing plate supply section 21 for supplying the printing plate 3' to the plate cylinder 15 as will be described later.

There has been well known that titanium oxide and zinc oxide exhibit photosensitivity. Especially zinc oxide is used to obtain an electrostatic image by exposing to image-wise light when it is charged or applied with an electric voltage. This has been put into practice in an electro-fax in the field of electrophotography. However the property that the state of the surface of titanium oxide and zinc oxide change from lipophilic state to hydrophilic state upon exposure to active light has been newly discovered independently from generation of the photoelectric charge and was not found when use of titanium oxide and zinc oxide in electrophotography was investigated.

Especially conception of using such a property for a plate making is completely novel.

Titanium oxide and zinc oxide are preferable for forming the plate material 3. However titanium oxide is preferable to zinc oxide in view of sensitivity, i.e., the photosensitivity in change of the nature of the surface. Titanium oxide may be prepared by any known method. For example, it may be prepared by sulfuric acid calcination of ilmenite or titanium slug, or by chlorination under an elevated temperature and subsequent oxygen oxidization of ilmenite or titanium slug. Otherwise titanium oxide film may be formed by vacuum film formation such as vacuum deposition, sputtering or the like of titanium or titanium oxide as will be described later.

A layer containing therein titanium oxide or zinc oxide may be formed on the surface of the plate material 3 by any known method. For example, the following methods can be employed. (1) Coating the surface of the plate material with dispersion of fine crystals of titanium oxide or zinc oxide, (2) Coating the surface of the plate material with dispersion of fine crystals of titanium oxide or zinc oxide, and subsequently firing the layer thus formed, thereby reducing or removing the binder, (3) depositing titanium oxide or zinc oxide on the surface of the plate material 3 and (4) Coating organic compound of titanium or zinc such as titanium butoxide and forming a layer of titanium oxide or zinc oxide through hydrolyzing or firing oxidization of the coating. In this invention, a titanium oxide layer by vacuum deposition is especially preferable.

In the methods of (1) and (2), fine crystals of titanium oxide may be coated, for instance, by coating dispersion of mixture of titanium oxide and silicone oxide and forming a surface layer or by coating a mixture of titanium oxide and organopolysiloxane or its monomer. Further fine crystals of titanium oxide may be coated in the form of dispersion in polymer binder which can coexist with the oxide. As the binder, various polymers dispersive to fine particles of titanium oxide can be used. As such polymer binder, polyalkylene polymer such as polyethylene, hydrophobic binders such as polybutadiene, polyacrylic ester, polymethacrylic ester, polyvinyl acetate, polyform acetate, polyethylene terephtalate, polyethylene naphthalate, polyvinyl alcohol and polystyrene are preferred and a mixture of these resins may also be used.

When carrying out vacuum deposition of titanium oxide in the method (3), a normal vacuum metallizer is evacuated to not higher than exp(−5) Torr and titanium oxide is heated by an electron beam under the condition of oxygen gas pressure of exp(−1 to −6) Torr, whereby titanium oxide is evaporated and forms film on the surface of the plate material 3.

When zinc oxide is used, zinc oxide film may be formed by any known method. It is preferred to use a method where the surface of a zinc plate is oxidized by electrolysis to form zinc oxide film or a method where zinc oxide film is formed by vacuum deposition.

Deposited film of zinc oxide may be formed by deposition of zinc or zinc oxide under existence of oxygen gas or by forming zinc film in an atmosphere without oxygen and subsequently oxidizing the zinc film by heating it to 700° C. in the air.

Either of titanium oxide film and zinc oxide film should be 1 to 10000 Å in thickness and preferably 10 to 10000 Å. In order to prevent strain due to interference of light, it is preferred that the film be not larger than 3000 Å in thickness. In order to ensure satisfactory photo-activity, it is preferred that the film be not smaller than 50 Å in thickness.

Though titanium oxide may be of any crystal form, anatase titanium oxide is preferred for its high sensitivity. As is well known, anatase can be obtained by firing titanium oxide under a selected condition. Amorphous titanium oxide and/or rutile titanium oxide may mingle with anatase titanium oxide. However preferably anatase titanium oxide exists at least in 40% and more preferably at least in 60% for the aforesaid reason.

The layer containing therein titanium oxide or zinc oxide generally should contain 30 to 100% by volume of titanium oxide or zinc oxide, and preferably not smaller than 50%. More preferably the layer comprises a continuous layer of titanium oxide or zinc oxide, that is, contains 100% of titanium oxide or zinc oxide.

Doping with a certain kind of metal is sometimes effective for enhancing the phenomenon that hydrophilicity of the surface changes upon exposure to light. For this purpose, doping with metal which is weak in ionization tendency such as Pt, Pd, Au, Ag, Cu, Ni, Fe or Co is preferable. Doping with a plurality of these metals may be employed.

When the volume fraction of titanium oxide or zinc oxide is small, sensitivity of change in hydrophilicity of the surface deteriorates. Accordingly it is preferred that the layer contains titanium oxide or zinc oxide in at least 30%.

The plate material 3 may be of various materials and may be in various forms. For example, the plate material 3 may comprise a base member of various materials and a layer of various photo-thermal hydrophilicity convertible materials such as titanium oxide, zinc oxide and the like formed on the surface of the base member in various ways such as those described above. The base member may be a metal plate, a flexible plastic sheet such as polyester or cellulose ester, or a paper sheet such as waterproof paper, polyethylene/paper laminate, or impregnated paper. As the metal plate, an aluminum plate, a stainless steel plate, a nickel plate and a copper plate are preferable. The metal plate may be flexible.

More specifically, when a layer of titanium oxide or zinc oxide is formed on a base member, the base member may be of various materials so long as it is dimensionally stable. For example, a paper; a paper sheet laminated with plastic such as polyethylene, polypropylene, or polystyrene; a metal plate such as of aluminum, zinc, copper or stainless steel; plastic film such as cellulose diacetate, cellulose triacetate, cellulose propionate, cellulose butyrate, cellulose acetate butyrate, cellulose nitrate, polyethylene terephthalate, polyethylene, polystyrene, polypropylene, polycarbonate, or polyvinyl acetal; and a paper sheet or plastic film laminated with or deposited with the above listed metals may be employed.

Polyester film, aluminum plate and a SUS plate which is resistant to corrosion on the printer are preferable as the base member. Among those, an aluminum plate is most preferable owing to its excellent dimensional stability and inexpensiveness. The aluminum plate may be of pure aluminum or of aluminum alloy containing therein a fine amount of impurity elements such as silicon, iron, manganese, copper, magnesium, chromium, zinc, bismuth, nickel, titanium or the like. The content of such impurity elements in the aluminum alloy is generally 10% by weight at most. Though pure aluminum is most preferred, perfectly pure aluminum is difficult to produce. The aluminum base member need not be of a particular composition and may be any known aluminum plate. The base member employed in the present invention is generally about 0.05 mm to 0.6 mm in thickness, preferably 0.1 to 0.4 mm and more preferably 0.15 to 0.3 mm.

The surface of the aluminum plate is roughened. If necessary, the surface is degreased to remove rolling oil thereon by use of surfactant, organic solvent or an alkaline solution before roughening the surface.

The surface of the aluminum plate may be roughened by various methods. For example, the surface may be mechanically roughened, may be roughened by electrochemical dissolution or may be roughened by selective chemical dissolution. The mechanical roughening may be effected by any known method such as ball grinding, brushing, blasting or buffing. The electrochemical roughening may be effected, for instance, by applying an AC current or a DC current in hydrochloric acid electrolyte or nitric acid electrolyte. Further the surface may be roughened by a combination of mechanical roughening and electrochemical roughening as disclosed in Japanese Unexamined Patent Publication No. 54(1979)-63902.

After the surface is roughened, the aluminum plate is subjected to alkaline etching treatment and neutralization treatment as required and then subjected to anodizing process, as desired, in order to enhance water retention characteristics and/or resistance to wear of the surface. In anodizing process of the aluminum plate, various electrolytes which forms porous oxide film may be used. As such electrolyte , sulfuric acid, hydrochloric acid, nitric acid, chromic acid or mixture of these acids is generally used. The concentration of the electrolyte may be suitably determined depending on the kind of the electrolyte used.

The condition of anodizing depends upon the kind of the electrolyte used and cannot be determined sweepingly. However electrolyte concentration of 1 to 80% by weight, electrolyte temperature of 5 to 70° C., current density of 5 to 60 $A/dm^2$, electric voltage of 1 to 100 V and electrolysis time of 10 seconds to 5 minutes are generally suitable.

When the amount of anodized film is less than 1.0 $g/m^2$, durability against printing becomes insufficient and/or the non-imaged region on the printing plate 3' becomes apt to be scratched, which results in adhesion of ink to the scratched portions.

The plate material 3 having a surface layer of titanium oxide or zinc oxide is originally lipophilic and is ink receptive. However when exposed to reversal-image-wise active light, the exposed part of the surface of the plate material 3 becomes hydrophilic and comes to repel ink with the unexposed part kept lipophilic. Accordingly, by only reversal-image-wise exposing the surface of the plate material 3, the plate material 3 can be imaged, whereby the printing plate 3' is made. Then the printing plate 3' is brought into contact with offset printing ink, thereby forming a printing surface where the non-imaged (exposed) region retains fountain solution and the imaged (unexposed) region retains ink. When a printing medium is brought into contact with the printing surface, the ink on the surface is transferred to the printing medium, whereby printing is effected.

The phenomenon that the surface of the photo-thermal hydrophilicity convertible material changes from a lipophilic state to a hydrophilic state upon exposure to light and returns to a lipophilic state when subsequently subjected to a heat treatment, on the basis of which the present invention is made is very remarkable. As the difference between the lipophilicity of the imaged region and the hydrophilicity of the non-imaged region increases, the non-imaged region and imaged region becomes more distinguishable from each other and the printing surface becomes clearer and the durability against repeated printing is enhanced. The degree of difference between the lipophilicity and hydrophilicity can be represented in terms of the contact angle with a droplet of water. As the hydrophilicity increases, the droplet of water spreads wider and the contact angle with the droplet becomes smaller. To the contrast, when the surface is water repellent (i.e., lipophilic), the contact angle becomes larger. That is, the plate material having a layer of the photo-thermal hydrophilicity convertible material such as titanium oxide or zinc oxide originally has a large contact angle with water but the contact angle is sharply reduced when the surface layer is exposed to active light, and the surface of the plate material comes to repel ink which is lipophilic. Accordingly by exposing the surface of the plate material 3 except the image-wise part, water repellent, ink receptive imaged region and a water receptive, ink repellent non-imaged region are formed on the surface, whereby a printing plate is formed.

The active light exposure section 5 of the plate making device 1 will be described hereinbelow.

In the printing system of this embodiment, the active light which excites the film containing therein titanium oxide or zinc oxide as a major component is light in the sensitive wavelength range for the oxide. In the case of anatase titanium oxide, the sensitive wavelength range is not longer than 387 nm, in the case of rutile titanium oxide, the sensitive wavelength range is not longer than 413 nm, and in the case of zinc oxide, the sensitive wavelength range is 387 nm. Accordingly, a mercury vapor lamp, a tungsten halogen lamp, other metal halide lamps, a xenon lamp and the like may be used as the active light source. A helium cadmium laser lasing at 325 nm and a water-cooled argon laser lasing at 351.1 to 363.8 nm can be also employed as the active light source. In gallium nitride lasers whose emissions at an ultraviolet to near ultraviolet region have been confirmed, an InGaN quantum-well semiconductor laser lasing at 360 to 440 nm and an optical waveguide MgO-$LiNbO_3$ laser having periodic domains reversals lasing at 360 to 430 nm can be used.

In the case of zinc oxide, spectral sensitivity may be increased by any known method and the light sources listed above may be used. Further other lamps having spectral distribution in the increased range such as a tungsten lamp may also be used.

As the surface layer is kept exposed to active light, the photo-thermal hydrophilicity convertible material such as titanium oxide or zinc oxide changes its state from a lipophilic state to a hydrophilic state and when all the photo-thermal hydrophilicity convertible material changes to the hydrophilic state, the degree of hydrophilicity is not increased any more even if exposure to the active light is further continued.

A preferred amount of active light to which the surface layer is to be exposed depends upon the property of the surface layer and a target level of distinguishability between the imaged region and the non-imaged region. In the case of a surface layer of titanium oxide or zinc oxide, the preferred amount of active light is generally 0.05 to 100 joule/$cm^2$, preferably 0.05 to 10 joule/$cm^2$ and more preferably 0.05 to 5 joule/$cm^2$.

The degree of change to the hydrophilic state of the photo-thermal hydrophilicity convertible material depends upon the total amount of active light to which the photo-thermal hydrophilicity convertible material is exposed. For example, exposure for 100 seconds at 10 $mW/cm^2$ results in the same effect as exposure for 1 second at 1 $W/cm^2$. Said range of the amount of light gives rise to no problem either in a surface exposure system nor in a beam scanning system.

The photosensitivity for the photo-thermal hydrophilicity convertible material to change from a lipophilic state to a hydrophilic state is different from that of zirconia ceramic disclosed in Japanese Unexamined Patent Publication No.

9(1997)-169098 in both the characteristic and the mechanism. On such photosensitivity of zirconia ceramic, it is disclosed that a laser beam of 7 W/$\mu m^2$ is required. This value corresponds to 70 joule/$cm^2$ when the duration of the laser beam is assumed to be 100 nanoseconds, which means that the photosensitivity of zirconia ceramic is lower than that of titanium oxide by one figure. Though not fully clarified, the mechanism by which titanium oxide changes the state of its surface is assumed to be a photo-dislocation reaction of lipophilic organic deposit and differs from that of zirconia ceramic. However since zirconia ceramic changes the state of its surface from a lipophilic state to a hydrophilic state upon exposure to light and from a hydrophilic state to lipophilic state when heated as titanium oxide or zinc oxide, also zirconia ceramic can be employed in this invention.

Though the non-imaged or exposed region of the resulting printing plate 3' is sufficiently rendered hydrophilic, the printing plate 3' may be subjected to, if desired, post treatment by use of a rinse solution containing surfactant, aqueous solution and the like and/or a grease insensitizing solution containing acacia gum and/or starch derivative.

For example, a flusher solution is coated on the surface of the printing plate 3' by wiping the surface with sponge or absorbent wadding soaked with the flusher solution, by dipping the printing plate 3' in a vat filled with the flushing agent or by use of an automatic coater. It is preferred that the thickness of the coating of the flushing solution be uniformed by a squeegee roller, a squeegee blade or the like after coating. The amount of the coating is generally 0.03 to 0.8 g/$m^2$ (by dry weight).

Then the treated printing plate 3' is discharged from the plate making device 1 and is wrapped around the plate cylinder 15 of the printer 2. Thereafter ink and fountain solution are supplied from the ink/water supply section 16 and fountain solution and ink are respectively held by the non-imaged (exposed) region and the imaged (unexposed) region. The ink image on the printing plate 3' is transferred to the blanket 18 from the printing plate 3' and then to a sheet of printing paper from the blanket 18.

As can be understood from the description above, the printing system of this embodiment, in particularly, the plate making device 1 in the printing system is advantageous over the conventional offset printer or plate making device in various points. First it is simple to handle. Further chemical processing using an alkaline developing solution is not necessary as well as wiping, brushing and the like which are conventionally required, which prevents environmental pollution by discharge of a developing solution.

The ink washing section 17 of the printer 2 will be described, hereinbelow.

After end of printing, the printing plate 3' is cleared of ink at the ink washing section 17. This is done by washing out ink adhering to the printing plate 3' by use of hydrophobic petroleum solvent. As such solvent, aromatic hydrocarbons such as kerosine are commercially available as a printing ink solvent. Further benzol, toluol, xylol, acetone, methyl ethyl ketone and mixtures of this solvent may be used.

The heating section 6 of the plate making device 1 will be described, hereinbelow. After cleaned of ink at the ink washing section 17 of the printer 2, the printing plate 3' is removed from the plate cylinder 15 and is wrapped around the exposure drum 4 of the plate making device 1. When the printing plate 3' is heat-treated by the heating section 6, the entire surface of the printing plate 3' becomes lipophilic. In this state, the printing plate 3' bears no imaged region and can be reused as the plate material 3. The heat treatment is generally carried out at a temperature not lower than 80° C., preferably not lower than 100° C. and not higher than the firing temperature of titanium oxide or zinc oxide. Higher the temperature is, shorter the treating time may be. More preferably the heat treatment is performed for ten minutes or more at 150° C. or for 1 minute or more at 200° C. or 10 seconds or more at 250° C. Though the heat treatment may be performed longer, further heat treatment after the entire surface is rendered lipophilic provides no advantage.

As the heat source for the heating section 6 may be any means so long as it satisfies the aforesaid conditions on the temperature and the time. Specifically, radiation heating by directly projecting infrared radiations onto the plate material, radiation heating by projecting infrared radiations onto the plate material with the plate material covered with a heat radiation absorbing sheet such as a carbon black sheet, hot air heating by blowing temperature controlled air or contact heating by contacting a hot plate, a heating roll or the like to the plate material. Though disposed around the exposure drum 4 in this embodiment, the heating section 6 may be disposed inside the exposure drum 4.

The plate material 3 thus recycled is stored not to be exposed to active light.

Though how many times the plate material 3 can be recycled has not been clear and is considered to be limited by unremovable stain, practically unamendable blemishes on the surface and/or mechanical deformation of the plate material, it can be recycled at least 15 times.

The operation of the printing system of this embodiment will be described, hereinbelow.

A plate material 3 is supplied to the housing body 7 from the plate material supply section 11 and then is wrapped around the exposure drum 4. A lith film bearing thereon a positive image is supplied from the film supply section 10 and is wrapped around the plate material 3 in close contact therewith. Then active light is emitted from the active light exposure section 5 and the entire surface of the plate material 3 is exposed to the active light through the lith film 9, whereby the region of the surface of the plate material 3 exposed to the active light is rendered hydrophilic and forms a non-imaged portion and the region of the surface of the plate material 3 shielded by the positive image on the lith film 9 is kept lipophilic and forms an imaged region. Thereafter emission of the active light is stopped and the lith film 9 is removed from the exposure drum 4 and discharged outside the housing body 7 through the film supply section 10. Thus a printing plate 3' bearing thereon a lipophilic imaged region and a hydrophilic non-imaged region is made. The printing plate 3' is removed from the exposure drum 4 and is discharged by the plate discharge section 12.

The printing plate 3' is conveyed to the printing plate supply section 21 manually or by a conveyor means (not shown). The printing plate 3' is further supplied to the plate cylinder 15 by the printing plate supply section 21 and is wrapped around the plate cylinder 15. Thereafter ink and fountain solution are supplied to the surface of the printing plate 3' from the ink/water supply section 16, whereby fountain solution and ink are respectively held by the non-imaged region and the imaged region. The ink image on the printing plate 3' is transferred to the blanket 18 from the printing plate 3' and then to a sheet of printing paper supplied between the blanket 18 and the impression cylinder 19 in the direction of arrow A (FIG. 1).

After end of printing, ink remaining on the surface of the printing plate 3' is removed by the ink removing section 17 and the printing plate 3' is demounted from the plate cylinder 15. Then the printing plate 3' is discharged through the printing plate supply section 21. The discharged printing plate 3' is conveyed to the plate material supply section 11 manually or by a conveyor means (not shown).

Then the printing plate 3' is wrapped around the exposure drum 4 of the plate making device 1 and is heated by the heating section 6. When the printing plate 3' is heat-treated by the heating section 6, the entire surface of the printing plate 3' becomes lipophilic and returns to the state before exposure to the active light.

As can be understood from the description above, in the printing system of this embodiment, the printing plate 3' can be made only by exposing the surface of the plate material 3 to active light without necessity of development. Further the printing plate 3' thus made is high in distinguishability between the imaged region and the non-imaged region, which ensures high sharpness of the printed image. Further since the printing plate 3' can be restored to the state where it bears thereon no image by heating the printing plate 3', the plate material 3 can be repeatedly used, whereby printed matter can be provided at low cost.

Further in this embodiment, since the plate material 3 is wrapped around the exposure drum 4 and the active light exposure section 5 and the heating section 6 are disposed around the exposure drum 4, imaging and heating can be effected only by rotating the exposure drum 4 and accordingly the plate making device 1 can be compact in size, whereby space can be saved.

A concrete example of the present invention will be described hereinbelow.

A rolled aluminum plate, 0.30 mm thick, of JISA1050 aluminum material containing 99.5% by weight of aluminum, 0.01% by weight of copper, 0.03% by weight of titanium, 0.3% by weight of iron and 0.1% by weight of silicon was prepared. The aluminum plate was subjected to sand dressing by use of 20% by weight aqueous suspension of 400 mesh "pamistone" (from Kyouritsu Yougyou) and a rotary nylon brush (6,10-nylon) and then washed well.

The aluminum plate was further dipped in a 15% by weight aqueous solution of sodium hydroxide (containing 4.5% by weight of aluminum) and etched so that aluminum was dissolved in an amount of 5 g/m$^2$. Then the aluminum plate was washed with running water. After neutralization by 1% by weight nitric acid, the surface of the aluminum plate was roughened by electric charge in a 0.7% by weight aqueous solution of nitric acid (containing 0.5% by weight of aluminum) by use of a rectangular wave alternating voltage (current ratio r=0.90, a current waveform disclosed in an embodiment in Japanese Patent Publication No. 58(1983)-5796). The voltage was 10.5 v when the aluminum plate was the anode and 9.3 v when the aluminum plate was the cathode, and the current when the aluminum plate was the anode was 160 coulomb/dm$^2$. After washing, the aluminum plate was further dipped in a 10% by weight aqueous solution of sodium hydroxide at 35° C. and etched so that aluminum was dissolved in an amount of 1 g/m$^2$, and then further washed. Thereafter the aluminum plate was further dipped in a 30% by weight aqueous solution of sulfuric acid at 50° C. to de-smut and washed with water.

Then the aluminum plate was subjected to porous anodized film forming process in a 20% by weight aqueous solution of sulfuric acid (containing 0.8% by weight of aluminum) at 35° C. by use of a direct current at a current density of 13 A/dm$^2$. The electrolysis time was controlled so that 2.7 g/m$^2$ of anodized film was formed.

The aluminum plate was washed with water and then dipped in a 3% by weight aqueous solution of sodium silicate at 70° C. for 30 seconds. The aluminum plate was then washed with water and dried.

The aluminum plate thus obtained was used as a base member. The aluminum base member was 0.30 in the reflection density as measured by a Macbeth reflection densitometer and 0.58 $\mu$m in centerline mean roughness.

The aluminum base member was placed in a vacuum metallizer and heated to 200° C. Then the vacuum metallizer was evacuated to $1.0\times10^{-8}$ Torr and titanium oxide was heated by an electron beam under the condition of oxygen gas pressure of $1.5\times10^{-4}$ Torr, whereby film of titanium oxide was formed on the aluminum base member. In this titanium oxide film, the ratio of amorphous component, anatase crystal component and rutile crystal component was 2.5/4.5/3 as analyzed by X-ray analysis. The titanium oxide was 750 Å in thickness. The aluminum base member having the titanium oxide film on the surface thereof thus obtained was used as a sample of the plate material 3.

The plate material 3 was wrapped around the exposure drum 4 and a lith film 9 bearing thereon positive image of a density of 400 lines/inch was wrapped around the exposure drum 4 over the plate material 3. The plate material 3 was exposed through the lith film 9 to light projected through a slit 10 cm wide a tan intensity of 35 mw/cm$^2$ from "USIO Printing Light Source Unit Unirec URM600 mode 1 GH-60201", (Usio Electric) while the plate material 3 was slowly rotated together with the exposure drum 4, so that the surface of the plate material 3 was uniformly exposed to light for 15 seconds. Then the contact angle with water droplet (in air) of the surface was measured by use of a CONTACT-ANGLE METER CA-D (Kyouwa Kaimen Kagaku K. K.). The contact angle was 5° in the exposed region (non-imaged region) and 80° in the unexposed region (imaged region).

The printing plate 31 thus prepared was set to a single-sided printer (Oliver 52 from Sakurai) and 1000 copies were offset by use of pure water as fountain solution and Newchampion F gross 85 India ink (from "Dainihon Ink Chemical"). Sharp printed matter was obtained from beginning to end and no damage was observed on the printing plate 3'.

Then the surface of the printing plate 3' was washed with printing ink cleaner "Dye-Clean R" (from "Dainihon Ink Chemical") to remove ink remaining thereon. Then the printing plate 3' was heated for 2 minutes at 180° C. and cooled to a room temperature. Then the contact angle with water droplet (in air) of the surface was measured in the same manner. The contact angle was in the range of 78 to 80° over the entire surface. That is, the printing plate returned to the original state.

Then the plate material was exposed to light under the same conditions except a lith film bearing thereon a different positive image was used. Then the contact angle with water droplet (in air) of the surface was measured in the same manner. The contact angle was 5° in the exposed region (non-imaged region) and 79° in the unexposed region (imaged region).

The printing plate 3' was set to a single-sided printer (Oliver 52 from Sakurai) and 1000 copies were offset by use of pure water as fountain solution and Newchampion F gross 85 India ink (from "Dainihon Ink Chemical"). Sharp printed matter was obtained from beginning to end and no damage was observed on the printing plate 3'.

This process was repeated 5 times. No change in repeatability in the photosensitivity, the contact angle and the speed at which the contact angle was recovered upon heating was observed.

A printing system in accordance with a second embodiment of the present invention will be described with reference to FIG. 2, hereinbelow.

Figure 2:
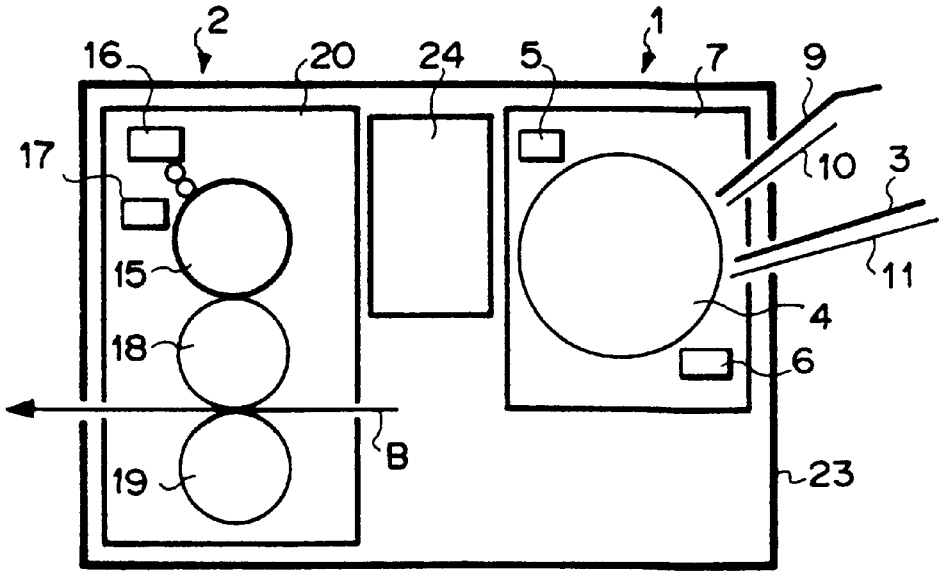
FIG. 2 is a schematic view for illustrating a printing system in accordance with a second embodiment of the present invention.

In FIG. 2, the elements analogous to those in the first embodiment are given the same reference numerals and will not be described here. The printing system of the second embodiment differs from that of the first embodiment in that the plate making device 1 and the printer 2 are housed in one unit 23 and a conveyor means 24 which conveys the printing plate 3' to the printer 2 from the plate making device 1 and to the plate making device 1 from the printer 2 is provided between the plate making device 1 and the printer 2.

The operation of the printing system of the second embodiment will be described, hereinbelow.

A plate material 3 is supplied to the housing body 7 from the plate material supply section 11 and then is wrapped around the exposure drum 4. A lith film 9 bearing thereon a positive image is supplied from the film supply section 10 and is wrapped around the plate material 3 in close contact therewith. Then active light is emitted from the active light exposure section 5 and the entire surface of the plate material 3 is exposed to the active light through the lith film 9, whereby the region of the surface of the plate material 3 exposed to the active light is rendered hydrophilic and forms a non-imaged portion and the region of the surface of the plate material 3 shielded by the positive image on the lith film 9 is kept lipophilic and forms an imaged region. Thereafter emission of the active light is stopped and the lith film 9 is removed from the exposure drum 4 and discharged outside the housing body 7 through the film supply section 10. Thus a printing plate 3' bearing thereon a lipophilic imaged region and a hydrophilic non-imaged region is made. The printing plate 3' is removed from the exposure drum 4 and is conveyed to the printer 2 by the conveyor means 24.

The printing plate 3' is further supplied to the plate cylinder 15 and is wrapped around the plate cylinder 15. Thereafter ink and fountain solution are supplied to the surface of the printing plate 3' from the ink/water supply section 16, whereby fountain solution and ink are respectively held by the non-imaged region and the imaged region.

The ink image on the printing plate 3' is transferred to the blanket 18 from the printing plate 3' and then to a sheet of printing paper supplied between the blanket 18 and the impression cylinder 19 in the direction of arrow B (FIG. 2).

After end of printing, ink remaining on the surface of the printing plate 3' is removed by the ink washing section 17 and the printing plate 3' is demounted from the plate cylinder 15. Then the printing plate 3' is conveyed to the plate making device 1 by the conveyor means 24.

Then the printing plate 3' is wrapped around the exposure drum 4 of the plate making device 1 and is heated by the heating section 6. When the printing plate 3' is heat-treated by the heating section 6, the entire surface of the printing plate 3' becomes lipophilic and returns to the state before exposure to the active light.

Though, in the embodiments described above, the ink removing section 17 is provided on the printer 2, it may be provided on the plate making device 1 or may be provided separately from both the plate making device and the printer 2.

Further though, in the first and second embodiments, the plate material 3 is wrapped around the exposure drum 4, the plate material 3 may be kept flat in a plate making device.

Figure 3:
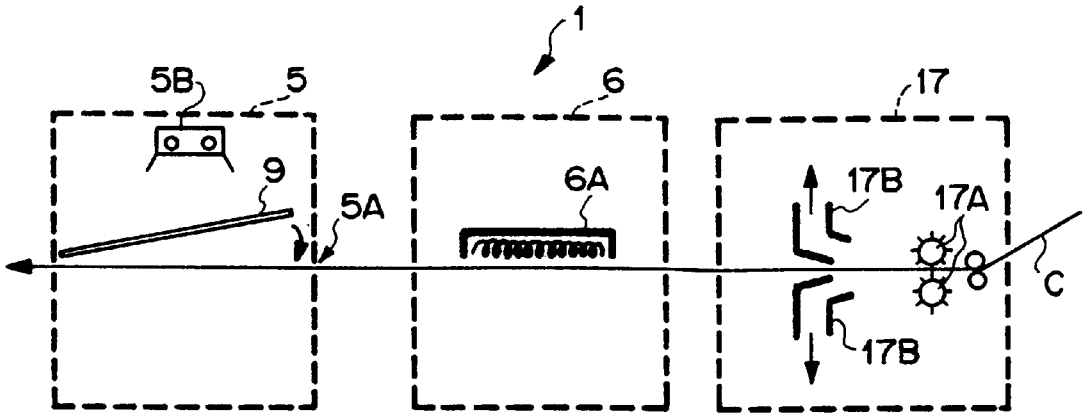
FIG. 3 is a schematic view for illustrating a plate making device in accordance with a third embodiment of the present invention.

A printing system in accordance with a third embodiment of the present invention in which the plate material 3 is kept flat will be described with reference to FIG. 3, hereinbelow. In FIG. 3, the elements analogous to those in the first embodiments are given the same reference numerals and will not be described in detail here. In the printing system of this embodiment, the ink washing section 17, which is provided in the printer 2 in the first and second embodiments, is provided in the plate making device 1, and the ink washing section 17, the heating section 6 and the active light exposure section 5 are arranged in series.

In FIG. 3, the ink washing section 17 comprises a pair of rollers 17A for wiping ink off and a cleaning solution supply section 17B which supplies a cleaning solution. The heating section is provided with a heat source 6A for heating the printing plate 3'. The active light exposure section 5 is provided with a contact section 5A for bringing the lith film 9 into close contact with the plate material 3 and a light source 5B for emitting active light.

The operation of the third embodiment will be described hereinbelow. The operation of the printer is the same as that of the first and second embodiments except the ink washing section 17 and accordingly will not be described here. After printing, the printing plate 3' is conveyed into the plate making device 1 as shown by arrow C in FIG. 3, and ink remaining on the surface of the printing plate 3' is removed by the ink washing section 17. Then the printing plate 3' is conveyed to the heating section 6 and is heated by the heating section 6. When the printing plate 3' is heat-treated by the heating section 6, the entire surface of the printing plate 3' becomes lipophilic and returns to the state before exposure to the active light. Then the plate material 3 is conveyed to the active light exposure section 5 and a lith film 9 is brought into close contact with the plate material 3 by the contact section 5A. Then active light is emitted from the light source 5B and the entire surface of the plate material 3 is exposed to the active light through the lith film 9, whereby the region of the surface of the plate material 3 exposed to the active light is rendered hydrophilic and forms a non-imaged region and the region of the surface of the plate material 3 shielded by the positive image on the lith film 9 is kept lipophilic and forms an imaged region. Thereafter emission of the active light is stopped and the lith film 9 is removed from the printing plate 3' and the printing plate 3' is conveyed to the printer 2.

Thus even if the plate material 3 is used kept flat, the printing plate 3' can be made only by exposing the surface of the plate material 3 to active light without necessity of development. Further the printing plate 3' thus made is high in distinguishability between the imaged region and the non-imaged region, which ensures high sharpness of the printed image. Further since the printing plate 3' can be restored to the original state by heating the printing plate 3' by the heating section 6, the plate material 3 can be repeatedly used, whereby printed matter can be provided at low cost.

Figure 4:
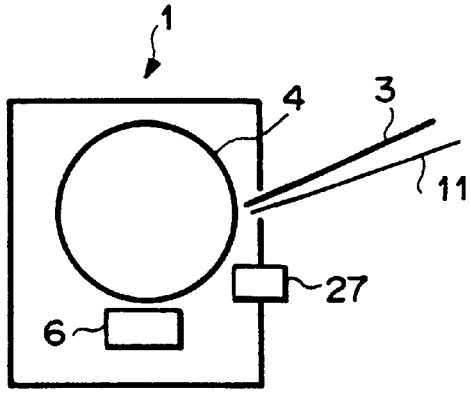
FIG. 4 is a schematic view for illustrating a plate making device in accordance with a fourth embodiment of the present invention.

A plate making device in accordance with a fourth embodiment of the present invention will be described with reference to FIG. 4, hereinbelow. In FIG. 4, the elements analogous to those of the first and second embodiments are given the same reference numerals and will not be described here. The plate making device of this embodiment differs from that in the first and second embodiments in that an active light exposure section 27 forms an image to be printed as a pattern of lipophilic region by scanning the surface of the plate material 3 with a laser beam modulated according to an image to be printed.

Figure 5:
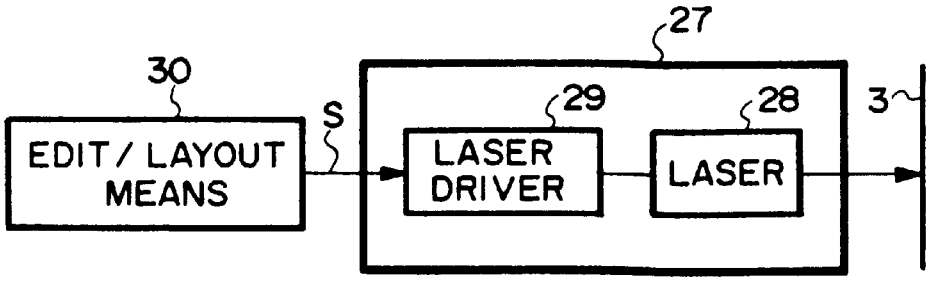
FIG. 5 is a schematic view for illustrating the active light exposure means in the fourth embodiment.

As shown in FIG. 5, the active light exposure section 27 comprises a laser 28 which emits a laser beam toward the surface of the plate material 3 and a laser driver 29 which drives the laser 28 to modulate the laser beam according to an image signal S from an edit/layout means 30 which generates an image signal S representing an image to be printed. The laser 28 causes the modulated laser beam to scan the surface of the plate material 3 in the direction of the axis of rotation of the exposure drum 4 while the plate material 3 is rotated together with the exposure drum 4, whereby the entire surface of the plate material 3 is scanned by the modulated laser beam. The region exposed to the laser beam is rendered hydrophilic (non-imaged region) with the region not exposed to the laser beam kept lipophilic (imaged region).

Though, in the example shown in FIG. 5, the laser beam is directly modulated by controlling the laser 28, the laser beam may be modulated by a combination of a laser and an external modulator such as acoustooptic element.

In gallium nitride lasers whose emissions at an ultraviolet to near ultraviolet region have been confirmed, an InGaN quantum-well semiconductor laser lasing at 360 to 440 nm and an optical waveguide MgO-$LiNbO_3$ laser having periodic domains reversals lasing at 360 to 430 nm can be used as the laser 28.

The operation of the fourth embodiment will be described, hereinbelow.

First an image signal S representing an image to be printed is input into the active light exposure section 27 from the edit/layout means 30 and the laser driver 29 drives the laser 28 according to the image signal S, thereby modulating the laser beam. The laser beam is caused to scan the plate material 3 while it is rotating, whereby the surface of the plate material is exposed to the laser beams over the substantially entire surface thereof with image-wise part kept unexposed. The region exposed to the laser beam is rendered hydrophilic (non-imaged region) with the region not exposed to the laser beam kept lipophilic (imaged region). Thus a printing plate 3' is made.

Thereafter emission of the active light is stopped and the printing plate 3' is removed from the exposure drum 4 and is conveyed to the printer 2.

The printing plate 3' is wrapped around the plate cylinder 15 and printing is carried out in the same manner as in the first and second embodiments. After end of printing, ink remaining on the surface of the printing plate 3' is removed by the ink washing section 17 and the printing plate 3' is demounted from the plate cylinder 15 and conveyed to the plate making device 1. Then the printing plate 3' is wrapped around the exposure drum 4 of the plate making device 1 and is heated by the heating section 6. When the printing plate 3' is heat-treated by the heating section 6, the entire surface of the printing plate 3' becomes lipophilic and returns to the state before exposure to the active light.

Thus in this embodiment, an image is written by scanning the surface of the plate material with a laser beam modulated according to an image signal S representing an image to be printed and accordingly lith film need not be made, whereby the mechanism for supplying the lith film may be eliminated and the plating making device 1 can be simplified in structure. Further the plate making step is simplified and consumption of material such as lith film can be suppressed.

Any light source such as an array source or a space modulation element can be employed in place of the laser 28 so long as it can expose the plate material 3 to light modulated according to an image signal S representing an image to be printed.

The active light exposure section 27 which forms an image to be printed as a pattern of lipophilic region by scanning the surface of the plate material 3 with a laser beam modulated according to an image to be printed may be employed also in the printing system of the third embodiment in place of the active light exposure section 5.

Further though, in the first, second and fourth embodiments, the plate material 3 is removably mounted on the exposure drum 4 and is transferred between the plate making device 1 and the printer 2, the plate material 3 may be the plate cylinder itself and the plate cylinder having a surface layer of the photo-thermal hydrophilicity convertible material may be removably mounted in both the plate making device 1 and the printer 2 so that an image is written on the plate material in the form of the plate cylinder removably mounted in the plate making device 1 in place of the exposure drum 4 and then the plate material in the form of the plate cylinder is transferred to the printer 2 and mounted in place of the plate cylinder 15.

A printing system in accordance with a fifth embodiment of the present invention will be described with reference to FIG. 6, hereinbelow.

Figure 6:
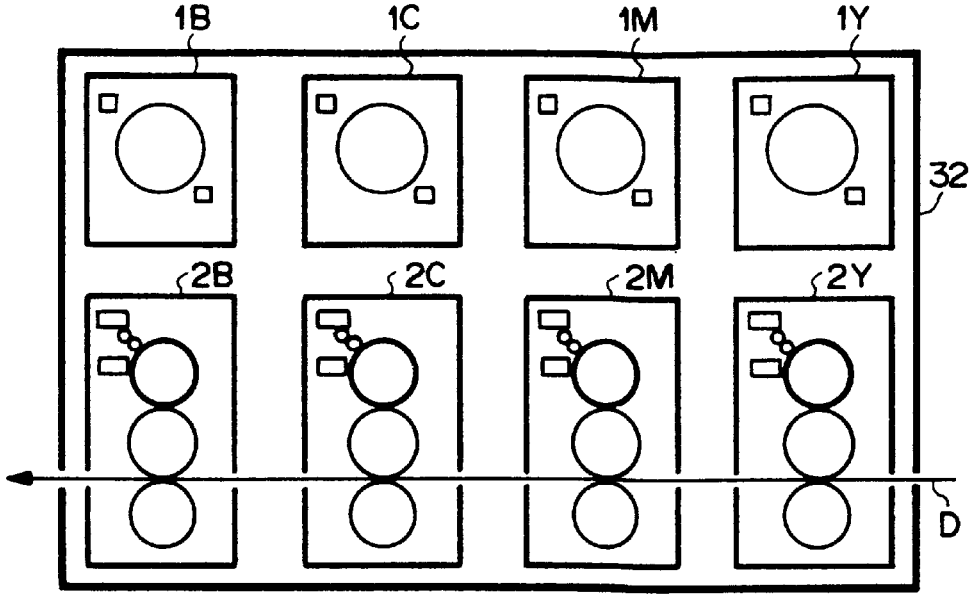
FIG. 6 is a schematic view for illustrating a printing system in accordance with a fifth embodiment of the present invention.

As shown in FIG. 6, the printing system of this embodiment comprises four plate making units 1Y, 1M, 1C and 1B, each equivalent to the plate making device 1 shown in FIG. 1, disposed in a housing body 32 in series and four printing units 2Y, 2M, 2C and 2B, each equivalent to the printer 2 shown in FIG. 1, disposed in the housing body 32 respectively opposed to the plate making units 1Y, 1M, 1C and 1B. The combination of the plate making unit 1Y and the printing unit 2Y is for printing by yellow ink, the combination of the plate making unit 1M and the printing unit 2M is for printing by magenta ink, the combination of the plate making unit 1C and the printing unit 2C is for printing by cyan ink, and the combination of the plate making unit 1B and the printing unit 2B is for printing by black ink.

Since each of the plate making units 1Y, 1M, 1C and 1B is the same as the plate making device 1 shown in FIG. 1 and each of the printing units 2Y, 2M, 2C and 2B are the same as the printer 2 shown in FIG. 1, they will not be described here. In the printing system of this embodiment, images to be printed in yellow, magenta, cyan and black are written on the plate materials in the respective plate making units 1Y, 1M, 1C and 1B and yellow ink, magenta ink, cyan ink and black ink are respectively supplied to the printing plates in the respective printing units 2Y, 2M, 2C and 2B.

The operation of the printing system of the fifth embodiment will be described, hereinbelow.

Lith films 9 each bearing thereon a positive image of the corresponding color are supplied to the respective plate making units 1Y, 1M, 1C and 1B and the plate materials 3 are exposed to the active light through the respective lith films 9, thereby obtaining four printing plates 3' for the respective colors. Then the printing plates 3' are supplied to the respective printing units 2Y, 2M, 2C and 2B. Thereafter ink of the respective colors and fountain solution are supplied to the surface of the printing plates 3' from the respective ink/water supply sections, whereby fountain solution and ink are respectively held by the non-imaged (exposed) regions and the imaged (unexposed) regions of the respective printing plates 3'. The ink images on the printing plates 3' are transferred to a sheet of printing paper in sequence supplied in the direction of arrow D. That is, a yellow ink image is transferred to the sheet of printing paper in the printing unit 2Y, a magenta ink image is transferred to the sheet of printing paper in the printing unit 2M, a cyan ink image is transferred to the sheet of printing paper in the printing unit 2C, and a black ink image is transferred to the sheet of printing paper in the printing unit 2B, whereby a color image is printed on the sheet of printing paper.

After end of printing, ink remaining on the surface of the printing plate 3' is removed by the ink washing section in each printing unit and the printing plates 3' are conveyed to the respective plate making units. In each of the plate making units 1Y, 1M, 1C and 1B, the heating section heats the printing plate 3', whereby the entire surface of the printing plate 3' becomes lipophilic and returns to the state before exposure to the active light.

Though, in the fifth embodiment, one plate making unit is provided for each printing unit, only a single plate making unit may be provided for all the printing units. In such a case, printing plates 3' for the printing units are made by the single plate making unit in sequence and supplied to the respective printing units from the single plate making unit. After printing, all the printing plates 3' are returned to the single plate making unit and heated in sequence.

Further though in the fifth embodiment, each of the plate making units 1Y, 1M, 1C and 1B is equivalent to that shown in FIGS. 1 and 2, the plate making units equivalent to that shown in FIG. 3 where the plate material 3 is conveyed kept flat or that shown in FIG. 4 where the plate material 3 is exposed to a modulated light beam may be employed. When the plate making units equivalent to that shown in FIG. 3 are employed, the printing units need not be provided with the ink washing section.

A printing system in accordance with a sixth embodiment of the present invention will be described with reference to FIGS. 7 and 8, hereinbelow.

Figure 7:
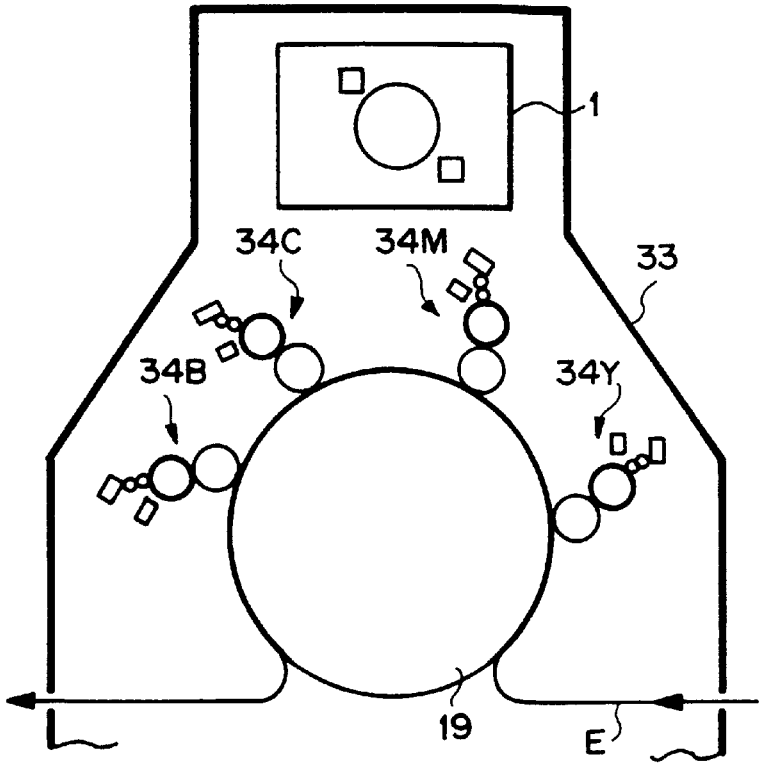
FIG. 7 is a schematic view for illustrating a printing system in accordance with a sixth embodiment of the present invention.
Figure 8:
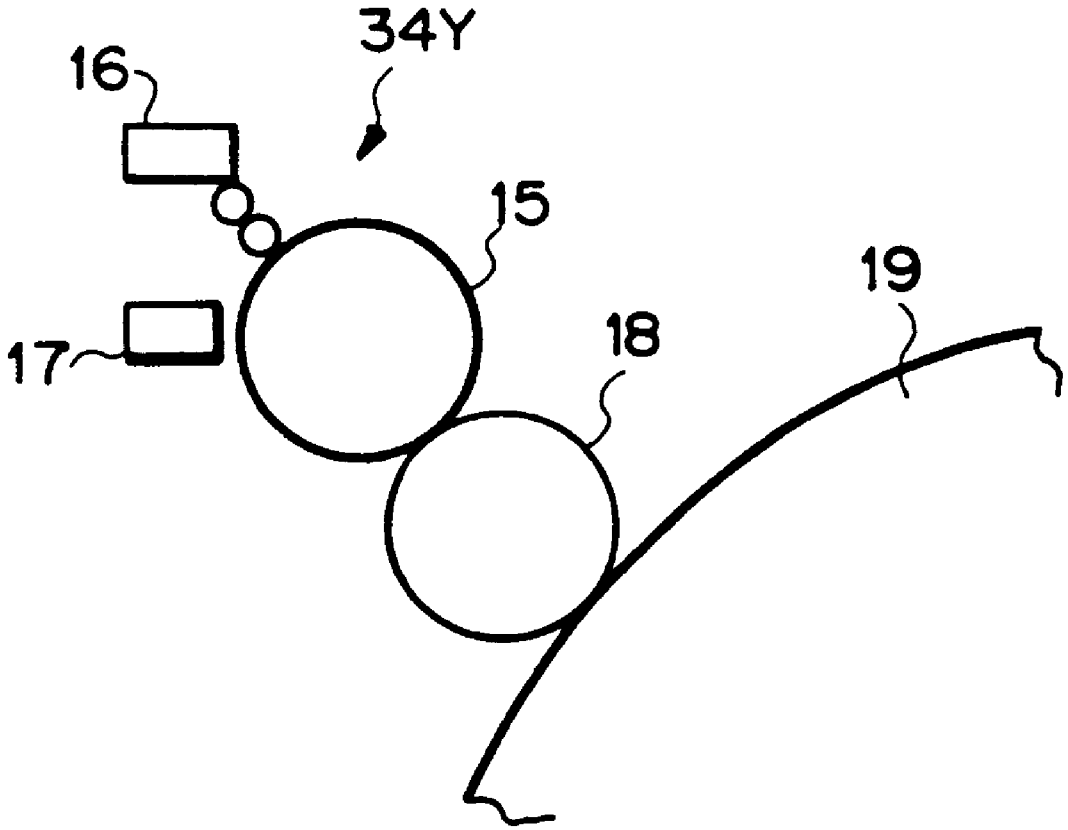
FIG. 8 is an enlarged view of an important part of the printing system.

FIG. 7 is a schematic view showing the arrangement of the printing system of the sixth embodiment and FIG. 8 is an enlarged view of an important part thereof. The printing system of this embodiment comprises a plate making device 1 equivalent to the plate making device 1 shown in FIGS. 1 and 2 provided in a housing body 33 and four printing stations 34Y, 34M, 34C and 34B, each equivalent to the printer 2 shown in FIGS. 1 and 2, disposed in the housing body 33 around a impression cylinder 19. The printing stations 34Y, 34M, 34C and 34B are for printing in yellow, magenta, cyan and black, respectively.

FIG. 8 shows the printing station 34Y. The other printing stations 34M, 34C and 34B are of the same structure as the printing station 34Y. As shown in FIG. 8, the printing station 34Y comprises an ink/water supply section 16 which supplies ink and fountain solution on the surface of the printing plate 3' mounted on a plate cylinder 15, an ink washing section 17 which removes ink on the printing plate 3' on the plate cylinder 15 after printing, a blanket 18 which is in contact with the impression cylinder 19 as an intermediate member for transferring ink on the printing plate 3' to a sheet of printing paper.

The operation of the plate making device 1 and the printing stations 34Y, 34M, 34C and 34B are the same as that in the printing system shown in FIGS. 1 and 2, and will not be described in detail here. In the sixth embodiment, images to be printed in the respective colors are written on the surfaces of four plate materials 3 in sequence by exposure to the active light in the plate making device 1. Thereafter ink of the respective colors and fountain solution are supplied to the surface of the printing plates 3' from the respective ink/water supply sections in the respective printing stations 34Y, 34M, 34C and 34B.

The operation of the printing system of the sixth embodiment will be described, hereinbelow.

Lith films 9 each bearing thereon a positive image of the corresponding color are supplied to the plate making units 1 and the plate materials 3 are exposed in sequence to the active light through the respective lith films 9, thereby obtaining four printing plates 3' for the respective colors. Then the printing plates 3' are supplied in sequence to the respective printing stations 34Y, 34M, 34C and 34B. Thereafter ink of the respective colors and fountain solution are supplied to the surface of the printing plates 3' from the respective ink/water supply sections, whereby fountain solution and ink are respectively held by the non-imaged (exposed) regions and the imaged (unexposed) regions of the respective printing plates 3'. The ink images on the printing plates 3' are transferred to a sheet of printing paper in sequence supplied in the direction of arrow E in FIG. 7 and conveyed along the impression cylinder 19. That is, a yellow ink image is transferred to the sheet of printing paper in the printing station 34Y, a magenta ink image is transferred to the sheet of printing paper in the printing station 34M, a cyan ink image is transferred to the sheet of printing paper in the printing station 34C, and a black ink image is transferred to the sheet of printing paper in the printing station 34B, whereby a color image is printed on the sheet of printing paper.

After end of printing, ink remaining on the surface of the printing plate 3' is removed by the ink washing section in each printing station and the printing plates 3' are conveyed to the plate making unit 1. In the plate making unit 1, the heating section heats the printing plate 3', whereby the entire surface of the printing plate 3' becomes lipophilic and returns to the state before exposure to the active light.

Though in the printing system of the sixth embodiment, the printing plates 3' for all the printing stations are made by the single plate making device 1, one plate making device may be provided for each printing section so that each plate making device makes the printing plate 3' for one printing station.

Further though in the sixth embodiment, the plate making device 1 is equivalent to that shown in FIGS. 1 and 2, the plate making device equivalent to that shown in FIG. 3 where the plate material 3 is conveyed kept flat to be exposed to the active light and to be heated may be employed. In this case, the printing stations need not be provided with the ink washing section.

Further though in the printing systems of the fifth and sixth embodiments, color printing is performed by use of four printing units 2Y, 2M, 2C and 2B or four printing stations 34Y, 34M, 34C and 34B, it is possible to perform color printing by use of five or more printing units or stations.

Further though, in the fifth and sixth embodiments, the plate materials 3 which are removably mounted on the exposure drums 4 are transferred between the plate making devices 1 and the printing units or stations, the plate material 3 may be the plate cylinder themselves and the plate cylinders having a surface layer of the photo-thermal hydrophilicity convertible material may be removably mounted in both the plate making devices 1 and the printing units or the stations so that an image is written on the plate material in the form of the plate cylinder removably mounted in each of the plate making device 1 in place of the exposure drum 4 and then the plate material in the form of the plate cylinder is transferred to the printing units or stations and mounted in place of the plate cylinder 15.

Further though, in the fifth and sixth embodiments described above, the ink removing section is provided on each printing unit of station, it may be provided on the plate making device or unit or may be provided separately from both the plate making device or unit and the printing unit or station.

An offset printer in accordance with a seventh embodiment of the present invention will be described with reference to FIG. 9, hereinbelow.

Figure 9:
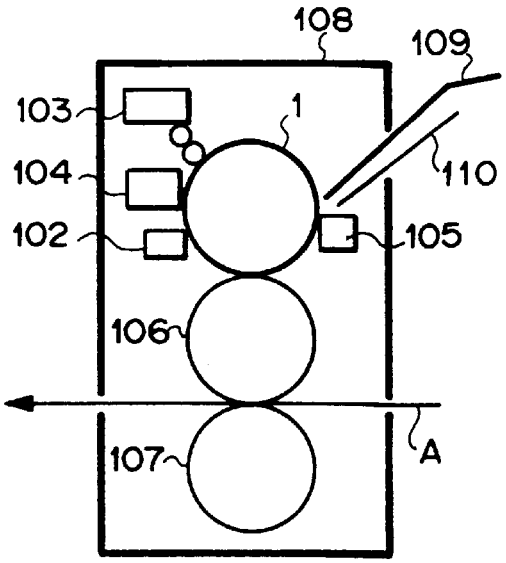
FIG. 9 is a schematic view for illustrating an offset printer in accordance with a seventh embodiment of the present invention.

In FIG. 9, an offset printer of this embodiment comprises a plate cylinder 101 having a surface layer containing a photo-thermal hydrophilicity convertible material such as titanium oxide or zinc oxide as a major component, an active light exposure section 102 which exposes the plate cylinder 1 to active light over the substantially entire surface thereof with image-wise part kept unexposed, an ink/water supply section 103 which supplies ink and fountain solution on the surface of the plate cylinder 101 on which has been exposed to the active light, an ink washing section 104 which removes ink on the plate cylinder 101 after printing, a heating section 105 which heats the plate cylinder 101, a blanket 106 as an intermediate member for transferring ink on the plate cylinder 101 to a sheet of printing paper and a impression cylinder 107 which presses the sheet of printing paper against the blanket 106. These elements are disposed inside a printer housing 108. Further the printer housing 108 is provided with a film supply section 110 for supplying a lith film 109.

Titanium oxide and zinc oxide are preferable for forming the surface layer of the plate cylinder 101. However titanium oxide is preferable to zinc oxide in view of sensitivity, i.e., the photosensitivity in change of the nature of the surface.

The surface layer containing therein titanium oxide or zinc oxide may be formed on the surface of the plate cylinder 101 by any known method. For example, the following methods can be employed. (1) Coating the surface of the plate cylinder 101 with dispersion of fine crystals of titanium oxide or zinc oxide, (2) Coating the surface of the plate cylinder 101 with dispersion of fine crystals of titanium oxide or zinc oxide, and subsequently firing the layer thus formed, thereby reducing or removing the binder, (3) depositing titanium oxide or zinc oxide on the surface of the plate cylinder 101 and (4) Coating organic compound of titanium or zinc such as titanium butoxide and forming a layer of titanium oxide or zinc oxide through hydrolyzing or firing oxidization of the coating. In this invention, a titanium oxide layer by vacuum deposition is especially preferable.

In the methods of (1) and (2), fine crystals of titanium oxide may be coated, for instance, by coating dispersion of mixture of titanium oxide and silicone oxide and forming a surface layer or by coating a mixture of titanium oxide and organopolysiloxane or its monomer. Further fine crystals of titanium oxide may be coated in the form of dispersion in polymer binder which can coexist with the oxide. As the binder, various polymers dispersive to fine particles of titanium oxide can be used.

When carrying out vacuum deposition of titanium oxide in the method (4), a normal vacuum metallizer is evacuated to not higher than exp(−5) Torr and titanium oxide is heated by an electron beam under the condition of oxygen gas pressure of exp(−1 to −6) Torr, whereby titanium oxide is evaporated and forms film on the surface of the plate cylinder 101.

When zinc oxide is used, zinc oxide film may be formed any known method. It is preferred to use a method where the surface of a zinc plate is oxidized by electrolysis to form zinc oxide film or a method where zinc oxide film is formed by vacuum deposition.

Deposited film of zinc oxide may be formed by deposition of zinc or zinc oxide under existence of oxygen gas or by forming zinc film in an atmosphere without oxygen and subsequently oxidizing the zinc film by heating it to 700° C. in the air. Either of titanium oxide film and zinc oxide film should be 1 to 10000 Å in thickness and preferably 10 to 10000 Å. In order to prevent strain due to interference of light, it is preferred that the film be not larger than 3000 Å in thickness. In order to ensure satisfactory photo-activity, it is preferred that the film be not smaller than 50 Å in thickness.

The surface layer containing therein titanium oxide or zinc oxide generally should contain 30 to 100% by volume of titanium oxide or zinc oxide, and preferably not smaller than 50%. More preferably the surface layer comprises a continuous layer titanium oxide or zinc oxide, that is, contains 100% of titanium oxide or zinc oxide.

Doping with a certain kind of metal is sometimes effective for enhancing the phenomenon that hydrophilicity of the surface changes upon exposure to light.

When the volume fraction of titanium oxide or zinc oxide is small, sensitivity of change in hydrophilicity of the surface layer deteriorates. Accordingly it is preferred that the surface layer contains titanium oxide or zinc oxide in at least 30%.

The plate cylinder 101 may be of various materials and may be in various forms. For example, the plate cylinder 101 may comprise a base drum of various materials and a surface layer of various photo-thermal hydrophilicity convertible materials such as titanium oxide, zinc oxide and the like formed on the surface of the base drum in various ways such as those described above. Otherwise a surface plate comprising a base member and a surface layer of a photo-thermal hydrophilicity convertible material formed on the base member may be fixedly wrapped around the base drum. The surface can be made in the same manner as the aforesaid plate material described in conjunction with the first embodiment.

The plate cylinder 101 having a surface layer of a photo-thermal hydrophilicity convertible material such as titanium oxide or zinc oxide is originally lipophilic and is ink receptive. However when exposed to active light, the surface of the plate cylinder 101 becomes hydrophilic and comes to repel ink. When the plate cylinder 1 is exposed to active light over the substantially entire surface thereof with image-wise part kept unexposed, the exposed (non-imaged) region is rendered hydrophilic and comes to repel ink while the unexposed (imaged) region is kept lipophilic and receives ink. Then the plate cylinder 101 bearing thereon the image written by exposure to the active light is brought into contact with offset printing ink, thereby forming a printing surface where the non-imaged region retains fountain solution and the imaged region retains ink. When a printing medium is brought into contact with the printing surface, the ink on the surface is transferred to the printing medium, whereby printing is effected.

The active light exposure section 102, the ink washing section 104 and the heating section 105 may be the same as those described above in conduction with the preceding embodiments.

The plate cylinder 101 recycled by heating can be recused unless exposed to active light. Though how many times the plate cylinder 101 can be recycled has not been clear and is considered to be limited by unremovable stain, practically unamendable blemishes on the surface and/or mechanical deformation of the plate cylinder 101, it can be recycled at least 15 times.

The operation of the offset printer of this embodiment will be described, hereinbelow.

A lith film 109 bearing thereon a positive image is supplied from the film supply section 110 and is wrapped around the plate cylinder 101. Then active light is emitted from the active light exposure section 102 and the entire surface of the plate cylinder 101 is exposed to the active light through the lith film 109, whereby the region of the surface of the plate cylinder 101 exposed to the active light is rendered hydrophilic and forms a non-imaged region and the region of the surface of the plate cylinder 101 shielded by the positive image on the lith film 9 is kept lipophilic and forms an imaged region. Thereafter emission of the active light is stopped and the lith film 109 is removed from the plate cylinder 101 and discharged outside the housing body 108 through the film supply section 110.

Thereafter ink and fountain solution are supplied to the surface of the plate cylinder 101 from the ink/water supply section 103, whereby fountain solution and ink are respectively held by the non-imaged region and the imaged region.

The ink image on the plate cylinder 101 is transferred to the blanket 106 from the plate cylinder 101 and then to a sheet of printing paper supplied between the blanket 106 and the impression cylinder 107 in the direction of arrow A in FIG. 9.

After end of printing, ink remaining on the surface of the plate cylinder 101 is removed by the ink removing section 104 and is heated by the heating section 105. When the plate cylinder 101 is heat-treated by the heating section 105, the entire surface of the plate cylinder 101 becomes lipophilic and returns to the state before exposure to the active light.

As can be understood from the description above, in the offset printer of this embodiment, the printing surface can be made only by exposing the surface of the plate cylinder 101 to active light without necessity of development. Further the printing surface thus made is high in distinguishability between the imaged region and the non-imaged region, which ensures high sharpness of the printed image. Further since the plate cylinder 101 can be restored to the state where it bears thereon no image by heating the printing plate 3', the plate cylinder 101 can be repeatedly used, whereby printed matter can be provided at low cost. Further since the plate cylinder 101 need not be removed from the printer, there is no fear that foreign material such as dust adheres to the plate cylinder 101 when incorporating the printing plate in the printer as in the case of a conventional PS plate.

Further in this embodiment, since the active light exposure section 102, the ink/water supply section 103, the ink washing section 104 and the heating section 105 are disposed around the plate cylinder 101, the exposure of the plate cylinder 101 to the active light, supply of ink and fountain solution, ink washing and the heating can be effected only by rotating the plate cylinder 101 and accordingly the offset printer can be compact in size, whereby space can be saved.

Figure 10:
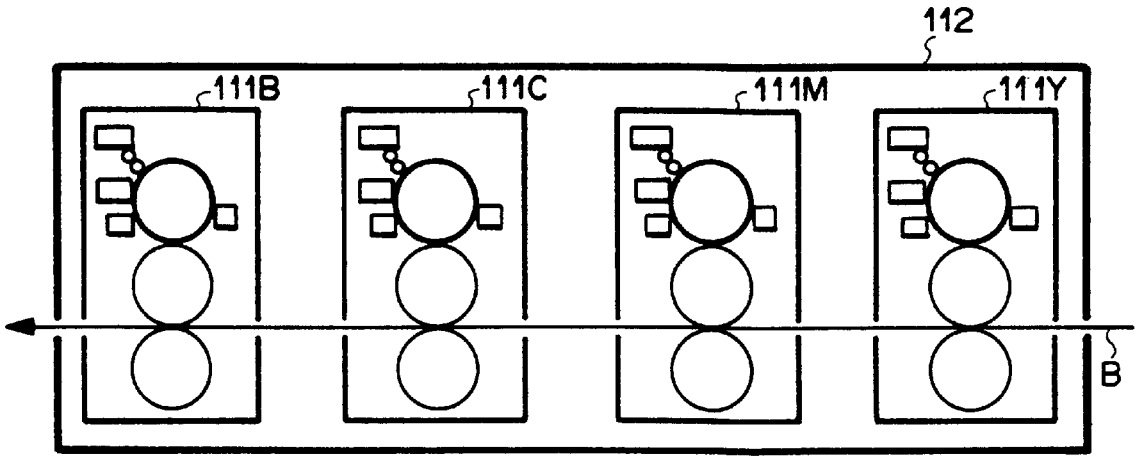
FIG. 10 is a schematic view for illustrating an offset printer in accordance with an eighth embodiment of the present invention.

An offset printer in accordance with an eighth embodiment of the present invention will be described with reference to FIG. 10, hereinbelow. As shown in FIG. 10, the offset printer of this embodiment comprises four printing units 111Y, 111M, 111C and 111B, each equivalent to the offset printer shown in FIG. 9, disposed in a housing body 112 in series. The printing unit 111Y is for printing by yellow ink, the printing unit 111M is for printing by magenta ink, the printing unit 111C is for printing by cyan ink, and the printing unit 111B is for printing by black ink.

Since each of the printing units 111Y, 111M, 111C and 111B are the same as the offset printer shown in FIG. 9, they will not be described here. In the offset printer of this embodiment, yellow ink, magenta ink, cyan ink and black ink are respectively supplied to the plate cylinder in the respective printing units 111Y, 111M, 111C and 111B.

The operation of the printing system of the eighth embodiment will be described, hereinbelow.

Lith films 9 each bearing thereon a positive image of the corresponding color are supplied to the respective plate making units 111Y, 111M, 111C and 111B and the plate cylinder 101 are exposed to the active light through the respective lith films 9. Thereafter ink of the respective colors and fountain solution are supplied to the surface of the plate cylinders 101 from the respective ink/water supply sections, whereby fountain solution and ink are respectively held by the non-imaged (exposed) regions and the imaged (unexposed) regions of the respective plate cylinders 101. The ink images on the plate cylinders 101 are transferred to a sheet of printing paper in sequence supplied in the direction of arrow B. That is, a yellow ink image is transferred to the sheet of printing paper in the printing unit 111Y, a magenta ink image is transferred to the sheet of printing paper in the printing unit 111M, a cyan ink image is transferred to the sheet of printing paper in the printing unit 111C, and a black ink image is transferred to the sheet of printing paper in the printing unit 111B, whereby a color image is printed on the sheet of printing paper.

After end of printing, ink remaining on the surface of the plate cylinder 101 is removed by the ink washing section in each printing unit and the heating section heats the plate cylinder 101, whereby the entire surface of the plate cylinder 101 becomes lipophilic and returns to the state before exposure to the active light.

An offset printer in accordance with a ninth embodiment of the present invention will be described with reference to FIGS. 11 and 12, hereinbelow.

Figure 11:
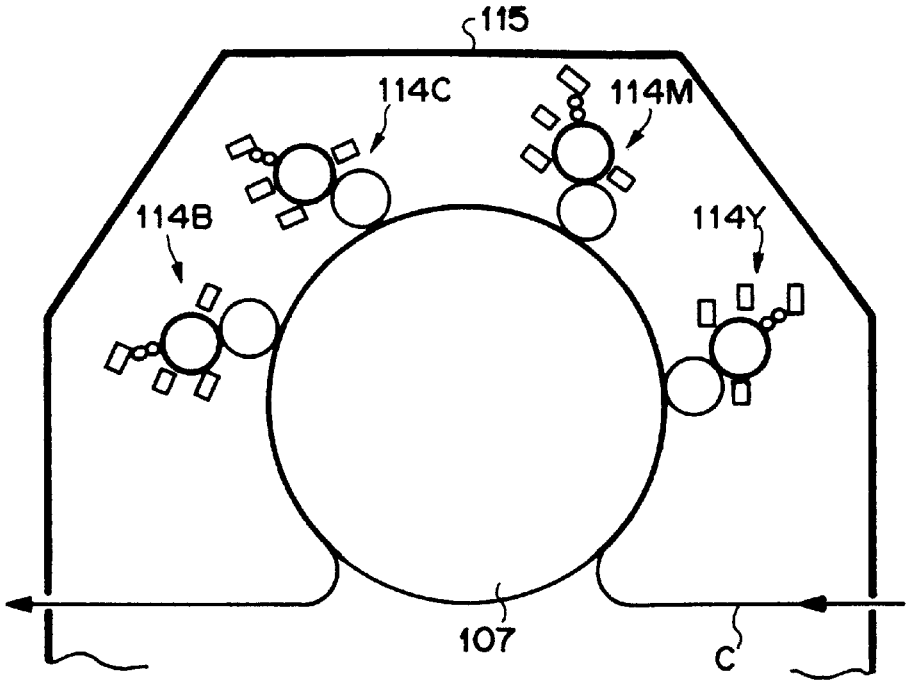
FIG. 11 is a schematic view for illustrating an offset printer in accordance with a ninth embodiment of the present invention.
Figure 12:
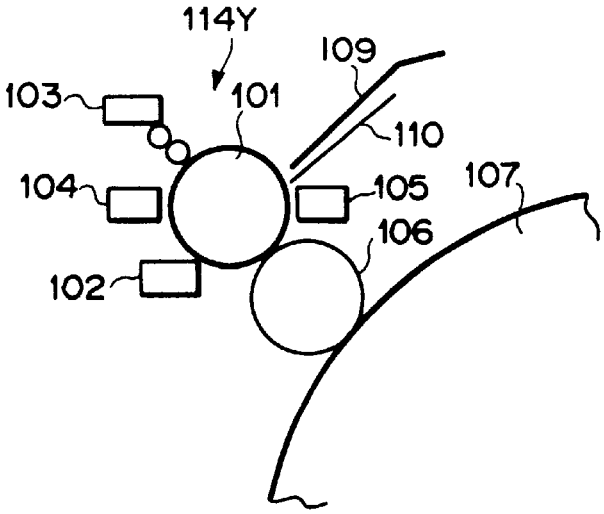
FIG. 12 is an enlarged view of an important part of the printer.

FIG. 11 is a schematic view showing the arrangement of the offset printer of the ninth embodiment and FIG. 12 is an enlarged view of an important part thereof. The offset printer of this embodiment comprises four printing stations 114Y, 114M, 114C and 114B, each equivalent to the offset printer shown in FIG. 9, disposed in a housing body 115 around a impression cylinder 107. The printing stations 114Y, 114M, 114C and 114B are for printing in yellow, magenta, cyan and black, respectively.

FIG. 12 shows the printing station 114Y. The other printing stations 114M, 114C and 114B are of the same structure as the printing station 114Y. As shown in FIG. 12, the printing station 114Y comprises a plate cylinder 101 having a surface layer containing a photo-thermal hydrophilicity convertible material such as titanium oxide or zinc oxide as a major component, an active light exposure section 102 which exposes the plate cylinder 101 to the active light, an ink/water supply section 103 which supplies ink and fountain solution on the surface of the plate cylinder 101, an ink washing section 104 which removes ink on the plate cylinder 101 after printing, a heating section which heats the plate cylinder 101, a blanket 106 which is in contact with the impression cylinder 107 as an intermediate member for transferring ink on the plate cylinder 101 to a sheet of printing paper and a film supply section 110 for supplying a lith film 109.

The operation of the printing stations 114Y, 114M, 114C and 114B are the same as that of the printer shown in FIG. 9 and will not be described in detail here. In the offset printer of this embodiment, yellow ink, magenta ink, cyan ink and black ink are respectively supplied to the plate cylinders in the respective printing stations 114Y, 114M, 114C and 114B.

The operation of the printing system of the ninth embodiment will be described, hereinbelow.

Lith films 109 each bearing thereon a positive image of the corresponding color are supplied to the respective printing stations 114Y, 114M, 114C and 114B and the plate cylinders 101 are exposed to the active light through the respective lith films 9. Thereafter ink of the respective colors and fountain solution are supplied to the surface of the plate cylinders 101 from the respective ink/water supply sections, whereby fountain solution and ink are respectively held by the non-imaged (exposed) regions and the imaged (unexposed) regions of the respective plate cylinders 101. The ink images on the plate cylinders 101 are transferred to a sheet of printing paper in sequence supplied in the direction of arrow E in FIG. 11 and conveyed along the impression cylinder 107. That is, a yellow ink image is transferred to the sheet of printing paper in the printing station 114Y, a magenta ink image is transferred to the sheet of printing paper in the printing station 114M, a cyan ink image is transferred to the sheet of printing paper in the printing station 114C, and a black ink image is transferred to the sheet of printing paper in the printing station 114B, whereby a color image is printed on the sheet of printing paper.

After end of printing, ink remaining on the surface of the plate cylinder 101 is removed by the ink washing section in each printing station and then the heating section heats the plate cylinder 101, whereby the entire surface of the plate cylinder 101 becomes lipophilic and returns to the state before exposure to the active light.

Though in the offset printers of the eighth and ninth embodiments, color printing is performed by use of four printing units 111Y, 111M, 111C and 111B or four printing stations 114Y, 114M, 114C and 114B, it is possible to perform color printing by use of five or more printing units or stations.

A tenth embodiment of the present invention will be described with reference to FIGS. 13 and 14, hereinbelow.

Figure 13:
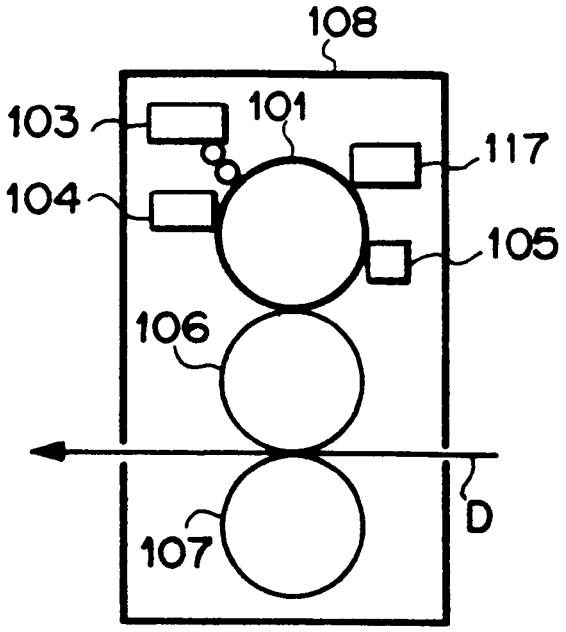
FIG. 13 is a schematic view for illustrating an offset printer in accordance with a tenth embodiment of the present invention.
Figure 14:
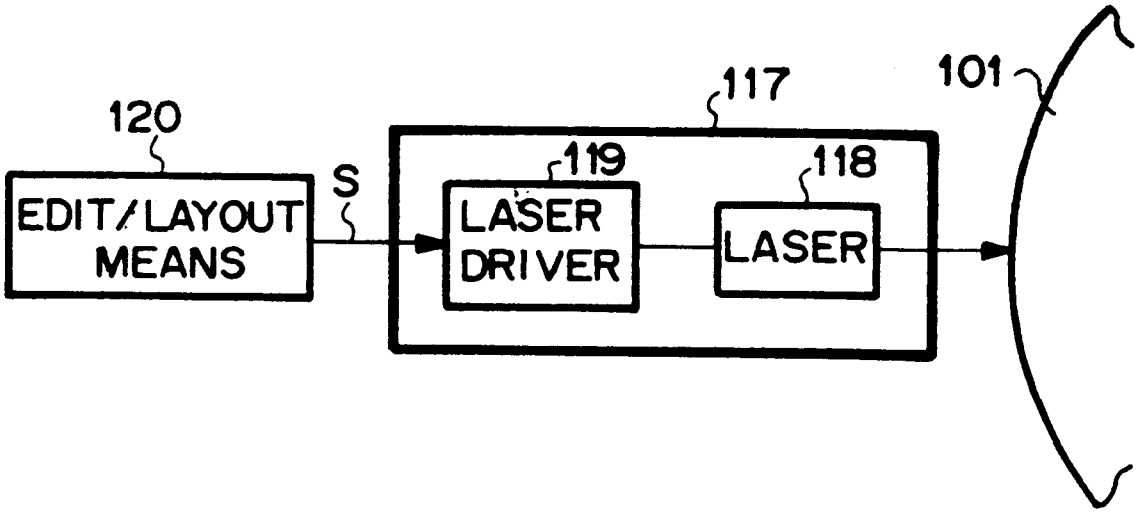
FIG. 14 is a schematic view showing the active light exposure section in the tenth embodiment.

In FIGS. 13 and 14, the elements analogous to those of the seventh embodiment are given the same reference numerals and will not be described here. The offset printer of this embodiment differs from the seventh embodiment in that an active light exposure section 117 forms an image to be printed as a pattern of lipophilic region by scanning the surface of the plate cylinder 101 with a laser beam modulated according to an image to be printed.

As shown in FIG. 14, the active light exposure section 117 comprises a laser 118 which emits a laser beam toward the surface of the plate cylinder 101 and a laser driver 119 which drives the laser 118 to modulate the laser beam according to an image signal S from an edit/layout means 120 which generates an image signal S representing an image to be printed. The laser 118 causes the modulated laser beam to scan the surface of the plate cylinder 101 in the direction of the axis of rotation thereof while the plate cylinder 101 is rotated, whereby the entire surface of the plate cylinder 101 is scanned by the modulated laser beam. The region exposed to the laser beam is rendered hydrophilic (non-imaged region) with the region not exposed to the laser beam kept lipophilic (imaged region).

Though, in this embodiment, the laser beam is directly modulated by controlling the laser 118, the laser beam may be modulated by a combination of a laser and an external modulator such as acoustooptic element.

In gallium nitride lasers whose emissions at an ultraviolet to near ultraviolet region have been confirmed, an InGaN quantum-well semiconductor laser lasing at 360 to 440 nm and an optical waveguide $MgO\text{-}LiNbO_3$ laser having periodic domains reversals lasing at 360 to 430 nm can be used as the laser 118.

The operation of the tenth embodiment will be described, hereinbelow.

First an image signal S representing an image to be printed is input into the active light exposure section 117 from the edit/layout means 120 and the laser driver 119 drives the laser 118 according to the image signal S, thereby modulating the laser beam. The laser beam is caused to scan the plate cylinder 101 while it is rotating, whereby the surface of the plate cylinder 101 is exposed to the laser beams over the substantially entire surface thereof with image-wise part kept unexposed. The region exposed to the laser beam is rendered hydrophilic (non-imaged region) with the region not exposed to the laser beam kept lipophilic (imaged region).

Thereafter emission of the active light is stopped and ink and fountain solution are supplied to the surface of the plate cylinder 101 from the ink/water supply section, whereby fountain solution and ink are respectively held by the non-imaged (exposed) region and the imaged (unexposed) region of the plate cylinder 101.

The ink image on the plate cylinder 101 is transferred by way of the blanket 106 to a sheet of printing paper supplied between the blanket 106 and the impression cylinder 107 in the direction of arrow D in FIG. 13.

After end of printing, ink remaining on the surface of the plate cylinder 101 is removed by the ink washing section 104 and the plate cylinder 101 is heated by the heating section 105. When the plate cylinder 101 is heat-treated by the heating section 105, the entire surface of the plate cylinder 101 becomes lipophilic and returns to the state before exposure to the active light.

Thus in this embodiment, an image is written by scanning the surface of the plate material with a laser beam modulated according to an image signal S representing an image to be printed and accordingly lith film need not be made, whereby the mechanism for supplying the lith film may be eliminated and the offset printer can be simplified in structure. Further the printing step is simplified and consumption of material such as lith film can be suppressed.

Any light source such as an array source or a space modulation element can be employed in place of the laser 118 so long as it can expose the plate cylinder 101 to light modulated according to an image signal S representing an image to be printed.

By arranging four or more offset printers equivalent to the offset printer of this embodiment in series as in the eighth embodiment or around a impression cylinder as in the ninth embodiment, color printing can be performed.

Further though, in the seventh to tenth embodiments, a plate cylinder 101 is employed, the present invention can also be applied to an offset printer where a flat printing plate is used.

Further though, in the seventh to tenth embodiments, the ink washing section 104, the ink/water supply section 103 and the heating section 105 are arranged in this order in the clockwise direction from the active light exposure section 102, these sections may be arranged in any order.

Further though, in the first to tenth embodiments, titanium oxide or zinc oxide is used as the photo-thermal hydrophilicity convertible material, any other photo-thermal hydrophilicity convertible material may be employed.

What is claimed is:

1. A plate making device comprising:

a plate material having a surface layer formed of film including as its major component a material whose surface changes from a lipophilic state to a hydrophilic state by a photocatalytic reaction and returns to a lipophilic state when subsequently subjected to a heat treatment, an exposure means which exposes the plate material to active light over the substantially entire surface thereof with image-wise part kept unexposed, and a heating means which heats the plate material; wherein said major component of said film is titanium oxide or zinc oxide.

2. A plate making device as defined in claim 1 in which the plate material is in the form of a flat plate which is removably mounted on the surface of a drum and the exposure means and the heating means are disposed around the drum.

3. A plate making device as defined in claim 1 in which the plate material is in the form of a plate cylinder and the exposure means and the heating means are disposed around the plate cylinder.

4. A plate making device as defined in claim 1 in which the exposure means is a means which holds, on the plate material, a film bearing thereon an original image to be printed and exposes the plate material to active light through the film.

5. A plate making device as defined in claim 1 in which the exposure means is a means which causes an active light beam, modulated on the basis of an original image to be printed, to scan the surface of the plate material.

6. A plate making device as defined in claim 1 further comprising an ink removing means for removing ink remaining on the plate material after printing.

7. A printing system comprising:

a plate making device defined in claim 1, at least one printing unit including a plate support means on which a printing plate removed from the plate making device is removably mounted and an ink supply means which supplies ink to an imaged region of the printing plate, and an ink removing means for removing ink remaining on the printing plate after printing.

8. A printing system as defined in claim 7 in which the ink removing means is provided on the printing unit.

9. A printing system as defined in claim 7 in which the ink removing means is provided on the plate making device.

10. A printing system as defined in claim 7 in which at least four said printing units are provided.

11. An offset printer comprising:

a plate making section consisting of a plate material which has a surface layer formed of film including as its major component a material whose surface changes from lipophilic state to a hydrophilic state by a photocatalytic reaction and returns to a lipophilic state when subsequently subjected to a heat treatment, an exposure means which exposes the plate material to active light over the substantially entire surface thereof with image-wise part kept unexposed, an ink supply means which supplies ink to the unexposed region of the plate material, an ink removing means for removing ink remaining on the plate material after printing, and a heating means which heats the plate material, and a transfer section which transfers ink on the unexposed region of the plate material to a printing medium; wherein said major component of said film is titanium oxide or zinc oxide.

12. An offset printer as defined in claim 11 in which the plate material is in the form of a plate cylinder and the exposure means, the ink supply means, the removing means, and heating means are disposed around the plate cylinder.

13. An offset printer as defined in claim 11 in which the exposure means is a means which holds on the plate material a film bearing thereon an original image to be printed and exposes the plate material to active light through the film.

14. An offset printer as defined in claim 11 in which the exposure means is a means which causes an active light beam, modulated on the basis of an original image to be printed to scan the surface of the plate material.

15. An offset printer as defined in claim 11 in which at least four said plate making sections are provided.

* * * * *